US009008565B2

(12) United States Patent
Taniguchi

(10) Patent No.: US 9,008,565 B2
(45) Date of Patent: Apr. 14, 2015

(54) RECORDING MEDIUM STORAGE CASSETTE AND IMAGE FORMING APPARATUS INCLUDING SAME

(71) Applicant: KYOCERA Document Solutions Inc., Osaka (JP)

(72) Inventor: Susumu Taniguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/183,271

(22) Filed: Feb. 18, 2014

(65) Prior Publication Data

US 2014/0234000 A1 Aug. 21, 2014

(30) Foreign Application Priority Data

Feb. 21, 2013 (JP) ..... 2013-031718

(51) Int. Cl.
*G03G 15/00* (2006.01)
*B65H 1/04* (2006.01)

(52) U.S. Cl.
CPC .. *G03G 15/6505* (2013.01); *G03G 2215/00383* (2013.01)

(58) Field of Classification Search
CPC ..... G03G 15/65; G03G 2215/00383; G03G 15/6502; G03G 15/6505; G03G 15/00; B65H 1/00; B65H 1/04
USPC ..... 399/393; 271/145
See application file for complete search history.

(56) References Cited

U.S. PATENT DOCUMENTS

| | | | | |
|---|---|---|---|---|
| 6,916,019 | B2 * | 7/2005 | Takahashi | 271/145 |
| 8,186,671 | B2 * | 5/2012 | Nishiyama | 271/171 |
| 2003/0227127 | A1 * | 12/2003 | Chang | 271/171 |
| 2007/0189822 | A1 * | 8/2007 | Nakamura | 399/393 |
| 2007/0196150 | A1 * | 8/2007 | Kobayashi | 399/393 |
| 2010/0221051 | A1 * | 9/2010 | Yamazaki et al. | 399/400 |
| 2011/0058883 | A1 * | 3/2011 | Kim | 400/613 |
| 2011/0140352 | A1 | 6/2011 | Tanaka | 271/264 |
| 2011/0210501 | A1 * | 9/2011 | Shiokawa et al. | 271/241 |
| 2011/0241286 | A1 * | 10/2011 | Ishii | 271/167 |
| 2012/0056370 | A1 * | 3/2012 | Kobayashi | 271/250 |
| 2014/0062012 | A1 * | 3/2014 | Yamamoto et al. | 271/264 |

FOREIGN PATENT DOCUMENTS

| | | | | |
|---|---|---|---|---|
| JP | 08133492 A | * | 5/1996 | B65H 1/04 |
| JP | 8-198458 A | | 8/1996 | |
| JP | 8-324804 A | | 12/1996 | |
| JP | 09208060 A | * | 8/1997 | B65H 1/04 |
| JP | 09309628 A | * | 12/1997 | G03G 15/00 |
| JP | 10129852 A | * | 5/1998 | B65H 1/04 |
| JP | 2000128363 A | * | 5/2000 | B65H 1/04 |
| JP | 2002255358 A | * | 9/2002 | G03G 15/00 |
| JP | 2004142892 A | * | 5/2004 | B65H 1/04 |

(Continued)

*Primary Examiner* — Nguyen Ha
(74) *Attorney, Agent, or Firm* — Stein IP, LLC

(57) ABSTRACT

A recording medium storage cassette includes a recording medium loading plate and a rear end cursor. The rear end cursor aligns rear end positions of recording media. The rear end cursor includes a cursor main body portion, an abutting portion that abuts rear ends of the recording media, a lock portion having a protrusion for engaging with a rack, and a biasing member disposed between the abutting portion and the lock portion so as to bias the abutting portion and the lock portion in a direction away from each other.

18 Claims, 4 Drawing Sheets

(56) References Cited

FOREIGN PATENT DOCUMENTS

| | | | | | |
|---|---|---|---|---|---|
| JP | 2004196436 | A | * | 7/2004 | B65H 1/04 |
| JP | 2005263497 | A | * | 9/2005 | G03G 15/00 |
| JP | 2007030995 | A | * | 2/2007 | B65H 1/04 |
| JP | 2009023803 | A | * | 2/2009 | B65H 1/04 |
| JP | 2009132469 | A | * | 6/2009 | B65H 1/04 |
| JP | 2010202287 | A | * | 9/2010 | B65H 1/04 |
| JP | 2010265091 | A | * | 11/2010 | B65H 1/04 |

* cited by examiner

RECORDING MEDIUM STORAGE CASSETTE AND IMAGE FORMING APPARATUS INCLUDING SAME

INCORPORATION BY REFERENCE

This application is based on and claims the benefit of priority from the corresponding Japanese Patent Application No. 2013-031718 filed on Feb. 21, 2013 at the Japanese Patent Office, the entire contents of which are hereby incorporated by reference.

BACKGROUND OF THE INVENTION

The present disclosure relates to a recording medium storage cassette used in an image forming apparatus such as a digital copier or a laser printer, for storing sheets of recording media, and to the image forming apparatus including the recording medium storage cassette.

Conventionally, there are widely used sheet feed cassettes (recording medium storage cassettes), which store a plurality of stacked sheets of paper (recording media) and feed the paper sheets one by one separately to an image forming portions of an image forming apparatus main body in accordance with image forming operation.

There is known a paper sheet cassette (sheet feed cassette) including a sheet stack tray on which paper sheets are stacked, a pressure spring under the sheet stack tray, and a paper sheet rear end guide (rear end cursor) for aligning rear ends of the paper sheets. The sheet stack tray is configured to be swingable so that its part on a downstream side in a paper sheet conveying direction can move up and down by the pressure spring. When the sheet stack tray moves upward by the pressure spring, the paper sheets stacked in the paper sheet cassette are pressed by a predetermined pressure to a feed roller (pickup roller) disposed on an apparatus main body side, so as to be fed.

The paper sheet rear end guide is configured to be movable in the paper sheet conveying direction along a guide groove formed on a bottom surface of the paper sheet cassette. In addition, the paper sheet rear end guide is provided with an auxiliary guide plate (abutting portion) for pressing the paper sheet rear ends toward the downstream side in the paper sheet conveying direction.

As the number of paper sheets in the paper sheet cassette becomes small, a slope of the sheet stack tray is increased so that a front end of the paper sheet slides backward. As a result, a nip state of the feed roller becomes unstable so that a paper feed error is apt to occur. Therefore, in this paper sheet cassette, there is disposed the auxiliary guide plate for pressing the paper sheet rear ends toward the downstream side in the paper sheet conveying direction in the paper sheet rear end guide. Thus, the paper sheets are moved toward the downstream side in the paper sheet conveying direction so as to suppress the paper feed error by stabilizing the nip state.

In addition, there is known a sheet feed cassette including a paper sheet case (cassette base) for housing paper sheets, a biasing plate (sheet stack tray) on which the paper sheets are stacked, a coil spring disposed under the biasing plate, and a regulating plate (cursor) for aligning ends of the paper sheets. The regulating plate is configured to be movable in the paper sheet conveying direction along a guide groove (rack) formed on a bottom surface of the paper sheet case. In addition, the regulating plate is provided with a stopper plate (lock portion) having an engaging portion (protrusion) that engages with the guide groove. The engagement between the engaging portion and the guide groove is released when the stopper plate is biased in a predetermined direction.

It is an object of the present disclosure to provide a recording medium storage cassette and an image forming apparatus including the same, which can suppress a paper feed error and suppress release of engagement of the rear end cursor with the cassette base.

SUMMARY OF THE INVENTION

A recording medium storage cassette according to an aspect of the present disclosure includes a cassette base, a recording medium loading plate, a rack, and a rear end cursor. The cassette base houses recording media. The recording medium loading plate is disposed in the cassette base in a swingable manner so that its part on a downstream side in a recording medium conveying direction can move up and down about an axis in a part on an upstream side in the recording medium conveying direction. The rack is formed on a bottom surface portion of the cassette base so as to extend along the recording medium conveying direction. The rear end cursor can move along the rack and aligns rear end positions of the recording media. The rear end cursor includes a cursor main body portion, an abutting portion which can move along the recording medium conveying direction with respect to the cursor main body portion so as to abut rear ends of recording media, a lock portion disposed upstream side of the abutting portion in the recording medium conveying direction so as to face the abutting portion and having a protrusion for engaging with the rack, and a biasing member disposed between the abutting portion and the lock portion so as to bias the abutting portion and the lock portion in a direction away from each other. The engagement between the protrusion of the lock portion and the rack is locked when the lock portion is biased toward the upstream side in the recording medium conveying direction, while the engagement is released when the lock portion is swung toward the downstream side in the recording medium conveying direction with respect to the cursor main body portion against the biasing force of the biasing member.

Further other objects of the present disclosure and specific advantages obtained by the present disclosure will become more apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE DRAWINGS

Now, an embodiment of the present disclosure is described with reference to the drawings.

Figure 1:
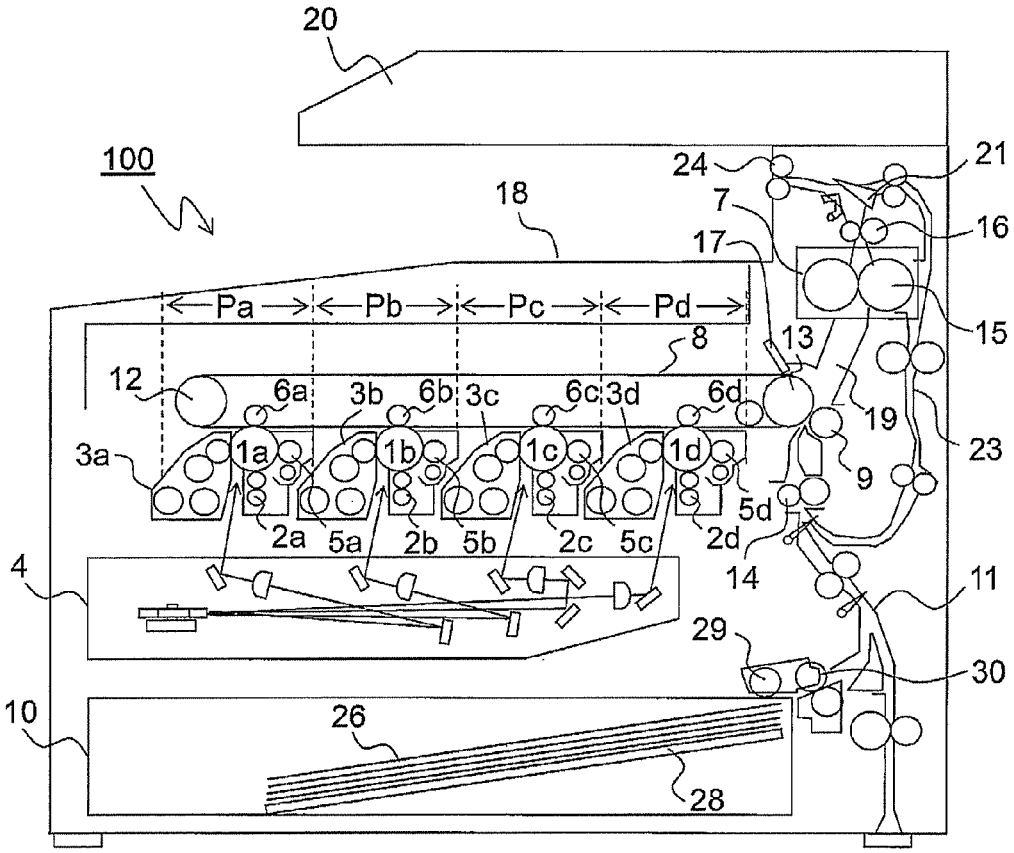
FIG. 1 is a cross-sectional view schematically illustrating a structure of an image forming apparatus including a sheet feed cassette according to an embodiment of the present disclosure.

With reference to FIGS. 1 to 6, an image forming apparatus 100 including a sheet feed cassette (recording medium storage cassette) 10 according to an embodiment of the present disclosure is described. As illustrated in FIG. 1, the image forming apparatus 100 is a tandem type color copier, and four image forming portions Pa, Pb, Pc and Pd are disposed in a main body of the image forming apparatus 100 in order from the left side in FIG. 1. The image forming portions Pa to Pd are disposed corresponding to four different color images (yellow, magenta, cyan and black images), and form yellow, magenta, cyan and black images, respectively and sequentially by charging, exposing, developing, and transferring steps.

The image forming portions Pa to Pd are provided with photoreceptor drums 1*a*, 1*b*, 1*c* and 1*d* each of which bears each color visible image (toner image). Further, an intermediate transfer belt 8 that turns counterclockwise in FIG. 1 is disposed adjacent to the image forming portions Pa to Pd. The toner images formed on the photoreceptor drums 1*a* to 1*d* are sequentially transferred and overlaid on the intermediate transfer belt 8 that moves while contacting with the photoreceptor drums 1*a* to 1*d*. Then, the overlaid images are transferred onto a paper sheet 26 as an example of the recording medium by action of a secondary transfer roller 9, and are fixed onto the paper sheet 26 by a fixing device 7. After that, the paper sheet 26 is discharged from the apparatus main body. The photoreceptor drums 1*a* to 1*d* are rotated clockwise in FIG. 1, and an image forming process is performed on the photoreceptor drums 1*a* to 1*d*.

The paper sheet 26 to which the toner image is transferred is housed in a sheet feed cassette 10 in a lower part of the apparatus. The paper sheets 26 are stacked on a sheet stack tray (recording medium loading plate) 28 of the sheet feed cassette 10. An upper surface of the paper sheet 26 is pressed to a pickup roller 29 by a predetermined pressure, and in this state the pickup roller 29 is rotated so that feeding of the paper sheet 26 is started. Then, only the uppermost sheet is separated from a plurality of paper sheets 26 by a feed roller pair 30 and is conveyed toward a paper sheet transport path 11. The paper sheet 26 after passing through the paper sheet transport path 11 reaches a registration roller pair 14 and is conveyed to a nip between the secondary transfer roller 9 and a drive roller 13 of the intermediate transfer belt 8 in synchronization with an image formation timing.

An image reading portion 20 is constituted of a scanning optical system equipped with a scanner lamp for illuminating a document to be copied and a mirror for bending an optical path of reflection light from the document, a condensing lens for condensing the reflection light from the document so as to form an image, and a CCD sensor for converting the light of the formed image into an electric signal (which are not illustrated). The image reading portion 20 reads a document image and converts the image into image data.

Further, an electric field of a predetermined transfer voltage is applied to between primary transfer rollers 6*a* to 6*d* and the photoreceptor drums 1*a* to 1*d* by the primary transfer rollers 6*a* to 6*d*. Thus, the yellow, magenta, cyan and black toner images on the photoreceptor drums 1*a* to 1*d* are primarily transferred onto the intermediate transfer belt 8. These four color images are formed with a predetermined positional relationship for forming a predetermined full color image. After that, for preparation of next formation of a new electrostatic latent image that is successively performed, toner remaining on the surface of photoreceptor drums 1*a* to 1*d* is removed by cleaning devices 5*a* to 5*d*.

The intermediate transfer belt 8 is stretched around a driven roller 12 and the drive roller 13. When a belt drive motor (not shown) rotates the drive roller 13, the intermediate transfer belt 8 starts to rotate counterclockwise. Then, the paper sheet 26 is conveyed from the registration roller pair 14 to a nip (secondary transfer nip) between the intermediate transfer belt 8 and the secondary transfer roller 9 disposed close to the intermediate transfer belt 8 at a predetermined timing, and the full color image is secondarily transferred onto the paper sheet 26 in the nip. The paper sheet 26 to which the toner image is transferred is conveyed to the fixing device 7.

When the paper sheet 26 conveyed to the fixing device 7 passes through a nip (fixing nip) of a fixing roller pair 15, it is heated and pressed so that the toner image is fixed onto a surface of the paper sheet 26 and a predetermined full color image is formed. The paper sheet 26 on which the full color image is formed passes through a conveying roller pair 16, and a conveying direction of the paper sheet 26 is selected by a conveying guide member 21 disposed at a branch portion of a paper sheet transport path 19. The paper sheet 26 is discharged to a discharge tray 18 via a discharge roller pair 24 as it is (or after being conveyed to a double-sided transport path 23 and after double-sided copy).

Next, a structure of the sheet feed cassette 10 is described. An insertion direction of the sheet feed cassette 10 with respect to the main body of the image forming apparatus 100 is perpendicular to the paper plane of FIG. 1. The paper feed direction of the sheet feed cassette 10 (the paper sheet conveying direction, or the recording medium conveying direction) is indicated by an arrow A (see FIG. 2).

Figure 2:
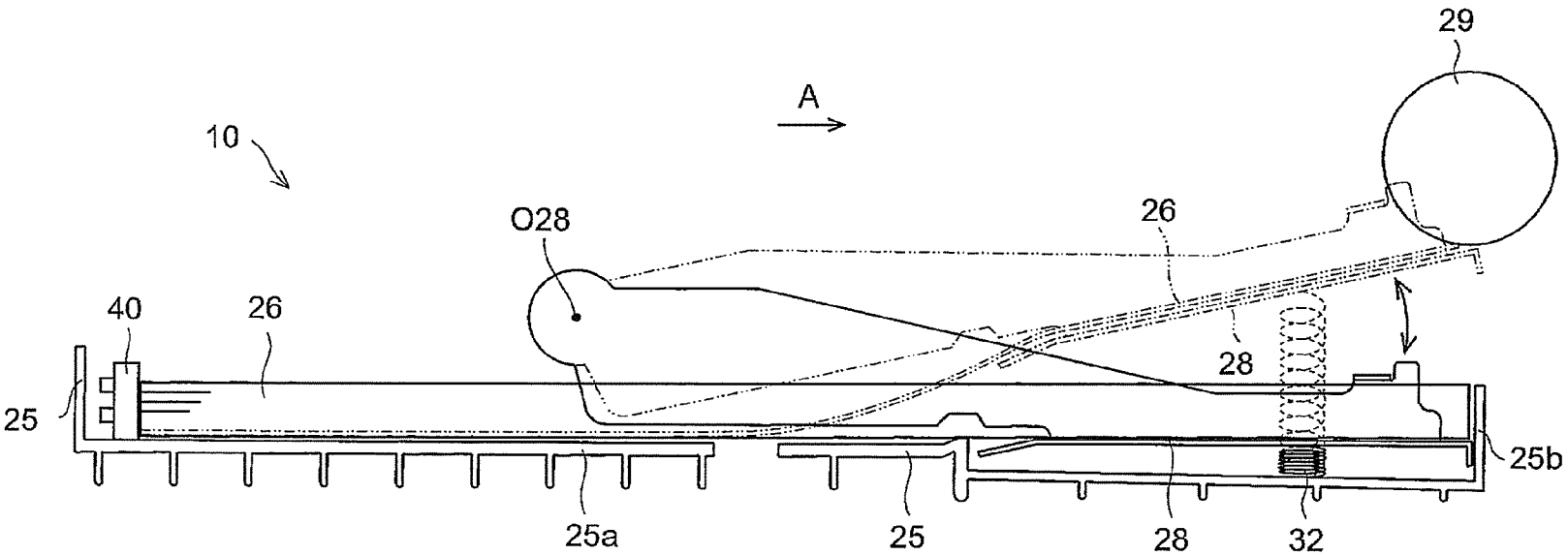
FIG. 2 is a cross-sectional side view illustrating a structure of the sheet feed cassette according to an embodiment of the present disclosure.

As illustrated in FIG.2, the sheet feed cassette 10 includes a cassette base 25 for housing the paper sheets 26, the sheet stack tray 28 on which the paper sheets 26 are stacked, a biasing member such as a compression coil spring 32 disposed under the sheet stack tray 28, a pair of width aligning cursors (not shown) for aligning the paper sheet 26 stacked on the sheet stack tray 28 in the width direction (perpendicular to the paper plane), and a rear end cursor 40 for aligning rear ends of the paper sheets 26.

Figure 3:
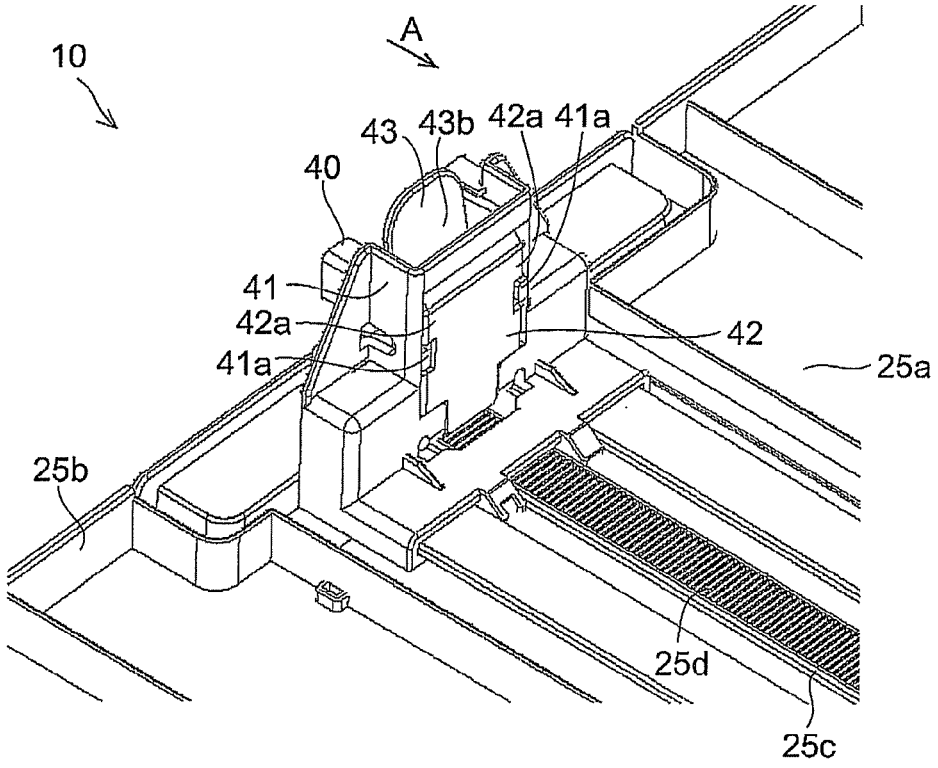
FIG. 3 is a perspective view illustrating a structure of a periphery of a rear end cursor of the sheet feed cassette according to an embodiment of the present disclosure.

The cassette base 25 constitutes a housing (case) of the sheet feed cassette 10 and includes a bottom surface portion 25*a*, and wall portions 25*b* standing from four edge sides of the bottom surface portion 25*a*. The bottom surface portion 25*a* is provided with a rack 25*c* formed to extend in the paper sheet conveying direction as illustrated in FIG. 3. The rack 25*c* is provided with many rack teeth 25*d* formed to extend in the width direction (perpendicular to the A-direction).

As illustrated in FIG. 2, the sheet stack tray 28 is disposed in a swingable manner about an axis that is a center axis O28 of a swing shaft (a part on the upstream side in the paper sheet conveying direction). By the biasing member such as the compression coil spring 32, for example, a part of the sheet stack tray 28 on the downstream side in the paper feed direction (in the direction of the arrow A) is moved up and down with respect to the cassette base 25.

The pair of width aligning cursors (not shown) are disposed on both sides in the width direction of the sheet stack tray 28 (perpendicular to the paper plane of FIG. 2 and perpendicular to the paper feed direction), in a manner capable of reciprocating respectively in the paper sheet width direction.

Figure 4:
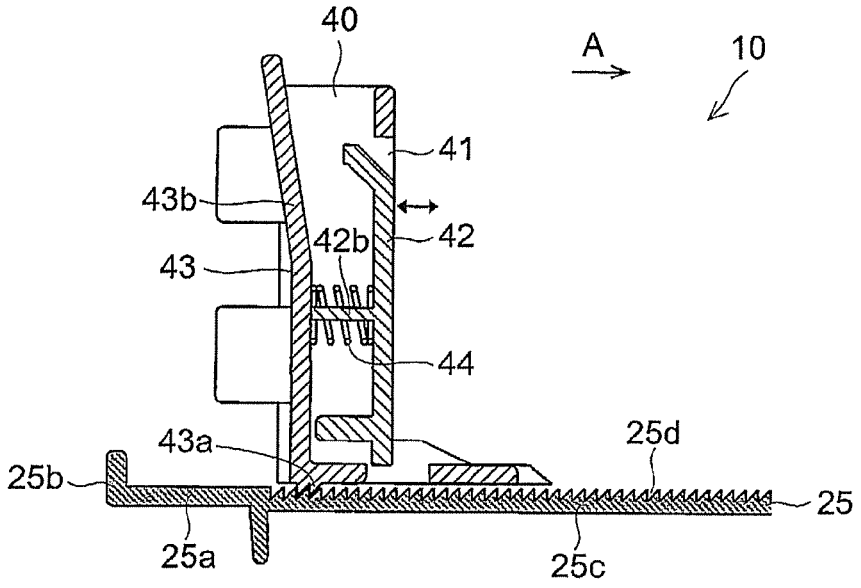
FIG. 4 is a cross-sectional side view illustrating the structure of the periphery of the rear end cursor of the sheet feed cassette according to an embodiment of the present disclosure.

As illustrated in FIGS. 3 and 4, the rear end cursor 40 is configured to be movable along the rack 25*c* formed on the bottom surface portion 25*a* of the cassette base 25. The rear end cursor 40 includes a cursor main body portion 41, an abutting portion 42 for abutting the rear ends of the paper sheets, a lock portion 43 disposed in the cursor main body portion 41, and a biasing member 44 disposed between the abutting portion 42 and the lock portion 43.

As illustrated in FIG. 3, the cursor main body portion 41 is provided with a pair of rail portions 41*a* formed to extend in parallel to the rack 25*c* (in the horizontal direction) so as to support the abutting portion 42 in a slidable manner.

Figure 5:
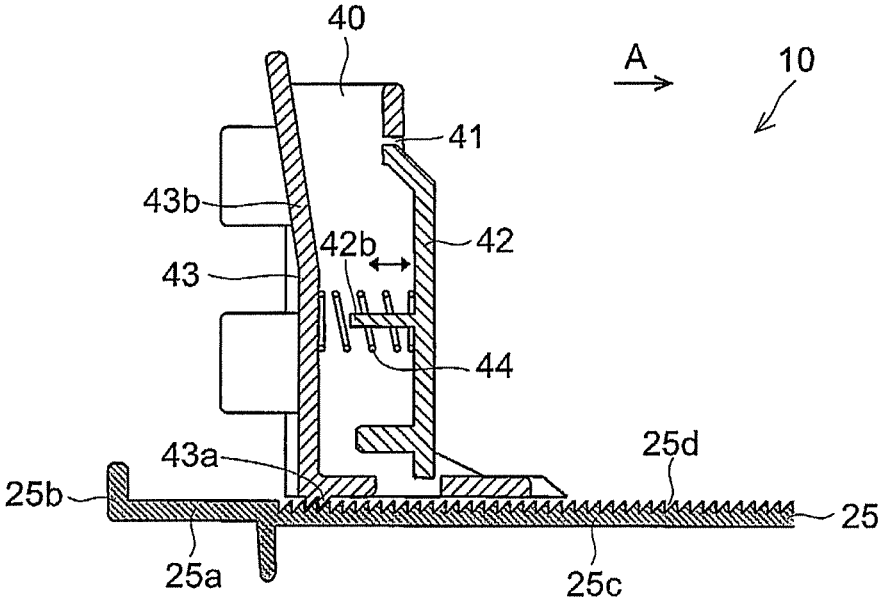
FIG. 5 is a cross-sectional side view illustrating the structure of the periphery of the rear end cursor of the sheet feed cassette according to an embodiment of the present disclosure.

The abutting portion 42 biases the rear ends of the paper sheets toward the downstream side in the paper sheet conveying direction (A-direction). In addition, the abutting portion 42 is provided with a pair of sliding portions 42*a* that slide along the rail portions 41 a of the cursor main body portion 41. Thus, as illustrated in FIGS. 4 and 5, the abutting portion 42 can move by approximately a few millimeters in a front and rear direction with respect to the cursor main body portion 41 (in parallel to the rack 25*c*). In addition, the abutting portion 42 is provided with a boss 42*b* for supporting the biasing member 44.

Figure 6:
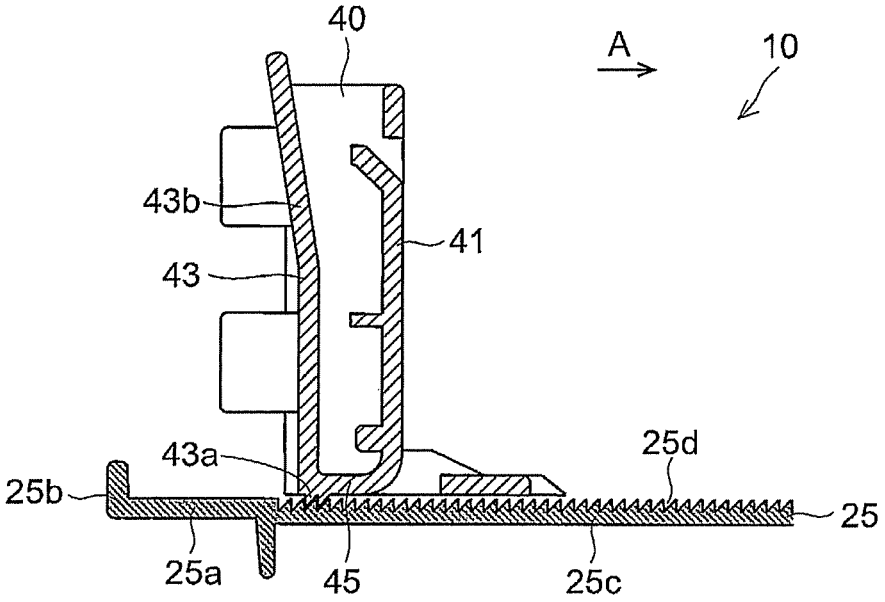
FIG. 6 is a cross-sectional side view illustrating the structure of the periphery of the rear end cursor of the sheet feed cassette according to an embodiment of the present disclosure.

An end in the width direction of a lower part of the lock portion 43 is connected to a lower part of the cursor main body portion 41 as illustrated in FIG. 6, which are integrally molded of resin. The lock portion 43 can swing with respect to the cursor main body portion 41 via a connection part 45 described later. The lowermost side of the lock portion 43 is provided with a protrusion 43*a* protruding downward. The protrusion 43*a* is configured to engage with the rack teeth 25*d* of the rack 25*c*. In addition, as illustrated in FIG. 4, the lock portion 43 is provided with a lever portion 43*b* opposed to the upstream side in the paper sheet conveying direction of the abutting portion 42. The lever portion 43*b* has a parallel part that is parallel to the abutting portion 42 and an inclined part that extends obliquely upward from the parallel part to the upstream side in the conveying direction (opposite to the A-direction).

The biasing member 44 is constituted of the compression coil spring and is disposed higher than the connection part 45 (see FIG. 6) that connects the lower part of the lock portion 43 and the lower part of the cursor main body portion 41. In addition, the biasing member 44 is disposed lower than a middle part of the lock portion 43 in a height direction. In addition, the biasing member 44 biases the abutting portion 42 toward the downstream side in the paper sheet conveying direction (A-direction) and biases the lock portion 43 toward the upstream side in the paper sheet conveying direction (opposite to the A-direction).

The engagement between the protrusion 43*a* and the rack 25*c* is locked when the lever portion 43*b* of the lock portion 43 is biased toward the upstream side in the paper sheet conveying direction (opposite to the A-direction), and is released when the lever portion 43*b* of the lock portion 43 is elastically deformed toward the downstream side in the paper sheet conveying direction (A-direction) with respect to the cursor main body portion 41 against the biasing force of the biasing member 44.

In this embodiment, if the number of the paper sheets 26 in the sheet feed cassette 10 is large as illustrated in FIG. 2 by a solid line, the compression coil spring 32 is compressed so that a slope of the sheet stack tray 28 is decreased. In this state, the pickup roller 29 forms a stable nip on the uppermost paper sheet 26 so that a paper feed error does not occur.

In addition, if the number of the paper sheets 26 in the sheet feed cassette 10 is large, the abutting portion 42 of the rear end cursor 40 is housed in the cursor main body portion 41 as illustrated in FIG. 4, and hence the boss 42*b* abuts the cursor main body portion 41 so that a paper sheet abutting surface (front surface) of the abutting portion 42 and a paper sheet abutting surface (front surface) of the cursor main body portion 41 are flush with each other.

Further, because the biasing member 44 is compressed at most in this state, the lock portion 43 is biased to the upstream side in the paper sheet conveying direction (opposite to the A-direction) by the largest force. Therefore, the engagement between the protrusion 43*a* and the rack 25*c* becomes strongest.

On the other hand, if the number of the paper sheets 26 in the sheet feed cassette 10 becomes small as illustrated in FIG. 2 by a double-dot-dashed line (for example, less than 20 sheets), the compression coil spring 32 extends so that the slope of the sheet stack tray 28 is increased. Then, the front end of the paper sheet 26 attempts to slide backward (opposite to the A-direction).

Here, in this embodiment, if the number of the paper sheets 26 in the sheet feed cassette 10 becomes small, the abutting portion 42 protrudes from the cursor main body portion 41 toward the downstream side in the paper sheet conveying direction (A-direction) by the biasing force of the biasing member 44 so that the biasing member 44 is extended as illustrated in FIG. 5. Then, the abutting portion 42 moves the paper sheets 26 toward the downstream side in the paper sheet conveying direction (A-direction). In this way, the front ends of the paper sheets 26 are prevented from sliding backward, and the nip state of the pickup roller 29 becomes stable so that a paper feed error does not occur.

Further, in this case, because the biasing force given to the lock portion 43 by the biasing member 44 is weakened, a force necessary for elastically deforming the lock portion 43 toward the downstream side in the paper sheet conveying direction (A-direction) becomes small. As a result, a user can easily release the engagement between the protrusion 43*a* and the rack 25*c*.

As described above, in this embodiment, the rear end cursor 40 includes the abutting portion 42 that abuts the rear ends of the paper sheet 26, and the biasing member 44 for biasing the abutting portion 42 toward downstream side in the paper sheet conveying direction (A-direction). In this way, when the number of paper sheets 26 in the sheet feed cassette 10 becomes small so that the slope of the sheet stack tray 28 becomes large, the abutting portion 42 can move the paper sheet 26 to the downstream side in the paper sheet conveying direction (A-direction). Therefore, it is possible to stabilize the nip state of the pickup roller 29 so that a paper feed error can be suppressed.

In addition, the biasing member 44 biases the lock portion 43 toward the upstream side in the paper sheet conveying direction (opposite to the A-direction), and the engagement between the protrusion 43*a* and the rack 25*c* is locked when the lock portion 43 is biased toward the upstream side in the paper sheet conveying direction (opposite to the A-direction). In this way, even if the lock portion 43 has a warp due to manufacturing variation or a vibration in the paper feed operation, it is possible to prevent the engagement between the protrusion 43*a* and the rack 25*c* from being released.

In addition, the engagement between the protrusion 43*a* and the rack 25*c* is released when the lock portion 43 is elastically deformed toward the downstream side in the paper sheet conveying direction (A-direction) with respect to the cursor main body portion 41 against the biasing force of the biasing member 44. When the number of the paper sheets 26 in the sheet feed cassette 10 becomes small, the abutting portion 42 is moved to the downstream side in the paper sheet conveying direction (A-direction) by the biasing force of the biasing member 44. Therefore, the biasing member 44 is extended so that the biasing force is weakened. Thus, when the paper sheets 26 are supplied to the sheet feed cassette 10 storing a small number of paper sheets 26, the user can easily deform the lock portion 43 elastically to the downstream side in the paper sheet conveying direction (A-direction) against the biasing force of the biasing member 44, and hence the engagement between the protrusion 43*a* and the rack 25*c* can be easily released.

In addition, as described above, the biasing member 44 is disposed higher than the connection part 45 between the lock portion 43 and the cursor main body portion 41. In this way, the lock portion 43 can be easily biased to the upstream side in the paper sheet conveying direction (opposite to the A-direction) by the biasing member 44, and hence the engagement between the protrusion 43*a* and the rack 25*c* can be easily secured.

In addition, as described above, the protrusion 43*a* is formed in the lower part of the lock portion 43. Thus, the lock portion 43 can be easily engaged with the rack 25*c*.

In addition, as described above, the lock portion 43 includes the lever portion 43*b* opposed to the upstream side in the paper sheet conveying direction of the abutting portion 42. Thus, the lock portion 43 can be easily deformed elastically to the downstream side in the paper sheet conveying direction.

In addition, as described above, in the state where the boss 42*b* abuts the lock portion 43, the paper sheet abutting surface of the abutting portion 42 and the paper sheet abutting surface of the cursor main body portion 41 are flush with each other. Thus, if the number of the paper sheets 26 in the sheet feed cassette 10 is large, it is possible to prevent the abutting portion 42 from protruding from the cursor main body portion 41 to the downstream side in the paper sheet conveying direction.

In addition, as described above, the cursor main body portion 41 is provided with the rail portions 41*a* extending in parallel to the rack 25*c* so as to support the abutting portion 42 in a slidable manner. Thus, because the abutting portion 42 moves in parallel to the rack 25*c*, the rear ends of the paper sheets 26 can be pressed by the abutting portion 42 in parallel to the rack 25*c*. Therefore, it is possible to suppress a warp of the rear end of the paper sheet 26.

Note that all the embodiments disclosed in this specification should be interpreted not to be limitations but to be examples in all points. The scope of the present disclosure is defined not by the above description of the embodiments but by the claims, and includes all modifications within the meaning and scope equivalent to the claims.

For instance, in the embodiments described above, there is described an example where the attachment and detachment direction of the sheet feed cassette with respect to the image forming apparatus main body is perpendicular to the paper sheet conveying direction. However, the present disclosure is not limited to this but can be applied to a sheet feed cassette whose attachment and detachment direction with respect to the image forming apparatus main body is parallel to the paper sheet conveying direction. In addition, the present disclosure can also be applied to a sheet feed cassette embedded in the image forming apparatus main body.

In addition, in the embodiments described above, there is described an example where the present disclosure is applied to a so-called retard paper feed mechanism using both the pickup roller 29 and the feed roller pair 30, but the present disclosure is not limited to this. For instance, the present disclosure can also be applied to a paper feed mechanism using a large diameter paper feed collar that works as both a pickup roller and a separating roller (feed roller).

In addition, in the embodiments described above, there is described an example where the boss for supporting the biasing member is disposed at the abutting portion, but the boss may be disposed at the cursor main body portion.

What is claimed is:

1. A recording medium storage cassette comprising:

a cassette base for storing recording media;

a recording medium loading plate disposed in the cassette base in a swingable manner so that its part on a downstream side in a recording medium conveying direction can move up and down about an axis in its part on an upstream side in the recording medium conveying direction;

a rack formed on a bottom surface portion of the cassette base so as to extend along the recording medium conveying direction; and a rear end cursor which can move along the rack and aligns rear end positions of the recording media, wherein the rear end cursor includes a cursor main body portion, an abutting portion which can move along the recording medium conveying direction with respect to the cursor main body portion so as to abut rear ends of the recording media, a lock portion disposed upstream side of the abutting portion in the recording medium conveying direction so as to face the abutting portion and having a protrusion for engaging with the rack, and a biasing member disposed between the abutting portion and the lock portion so as to bias the abutting portion and the lock portion in a direction away from each other, and the engagement between the protrusion of the lock portion and the rack is locked when the lock portion is biased toward the upstream side in the recording medium conveying direction, while the engagement is released when the lock portion is swung toward the downstream side in the recording medium conveying direction with respect to the cursor main body portion against the biasing force of the biasing member.

2. The recording medium storage cassette according to claim 1, wherein the lock portion is locked with the rack by being pushed toward the upstream side in the recording medium conveying direction via the biasing member as a result of the abutting portion being pushed toward the upstream side in the recording medium conveying direction by the recording medium when the abutting portion is disposed to abut the rear edge of the recording medium.

3. The recording medium storage cassette according to claim 1, wherein the rear end cursor further includes a connection part which connects a lower part of the lock portion with a lower part of the cursor main body portion, and the lock portion can swing with respect to the cursor main body portion via the connection part.

4. The recording medium storage cassette according to claim 3, wherein the protrusion is formed on the lower part of the lock portion.

5. The recording medium storage cassette according to claim 3, wherein the biasing member is disposed lower than a middle part in a height direction of the lock portion.

6. The recording medium storage cassette according to claim 1, wherein the lock portion includes the protrusion and a lever portion opposed to the upstream side in the recording medium conveying direction of the abutting portion.

7. The recording medium storage cassette according to claim 6, wherein the lever portion includes a parallel part which is parallel to the abutting portion, and an inclined part extending obliquely upward from the parallel part to the upstream side in the conveying direction.

8. The recording medium storage cassette according to claim 1, wherein one of the abutting portion and the lock portion is provided with a boss for supporting the biasing member, and a paper sheet abutting surface of the abutting portion and a paper sheet abutting surface of the cursor main body portion are flush with each other in a state where a head of the boss abuts the other of the abutting portion and the lock portion.

9. The recording medium storage cassette according to claim 1, wherein the cursor main body portion is provided with a rail portion extending in parallel to the rack so as to support the abutting portion in a slidable manner.

10. An image forming apparatus comprising the recording medium storage cassette according to claim 1.

11. An image forming apparatus comprising the recording medium storage cassette according to claim 2.

12. An image forming apparatus comprising the recording medium storage cassette according to claim 3.

13. An image forming apparatus comprising the recording medium storage cassette according to claim 4.

14. An image forming apparatus comprising the recording medium storage cassette according to claim 6.

15. An image forming apparatus comprising the recording medium storage cassette according to claim 8.

16. An image forming apparatus comprising the recording medium storage cassette according to claim 9.

17. An image forming apparatus comprising the recording medium storage cassette according to claim 5.

18. An image forming apparatus comprising the recording medium storage cassette according to claim 7.

* * * * *